US009991656B1

(12) United States Patent
Tsai et al.

(10) Patent No.: US 9,991,656 B1
(45) Date of Patent: Jun. 5, 2018

(54) CONNECTOR ASSEMBLY AND HYBRID CONNECTOR THEREOF

(71) Applicant: USI Electronics (Shenzhen) Co., Ltd., ShenZhen (CN)

(72) Inventors: Chu-Ching Tsai, Shanghai (CN); Ming-Yuan Hsieh, Shanghai (CN); Ming-Chieh Chuang, Shanghai (CN); Kuang-Fen Tseng, Shanghai (CN)

(73) Assignee: USI ELECTRONICS (SHENZHEN) CO., LTD., Shenzhen, Guangdong (CN)

( * ) Notice: Subject to any disclaimer, the term of this patent is extended or adjusted under 35 U.S.C. 154(b) by 0 days. days.

(21) Appl. No.: 15/784,787

(22) Filed: Oct. 16, 2017

(30) Foreign Application Priority Data

Jul. 31, 2017 (CN) ..... 2017 1 0638406

(51) Int. Cl.

| | |
|---|---|
| ***H01R 24/00*** | (2011.01) |
| ***H01R 27/00*** | (2006.01) |
| ***H01R 24/64*** | (2011.01) |
| *H01R 107/00* | (2006.01) |

(52) U.S. Cl.
CPC ..... *H01R 27/00* (2013.01); *H01R 24/64* (2013.01); *H01R 2107/00* (2013.01)

(58) Field of Classification Search
CPC ..... H01R 23/02; H01R 24/62
USPC ..... 439/660, 218
See application file for complete search history.

(56) References Cited

U.S. PATENT DOCUMENTS

| | | | | |
|---|---|---|---|---|
| 6,964,586 | B2 * | 11/2005 | Siddiqui | H01R 24/58 439/218 |
| 7,255,567 | B1 * | 8/2007 | Liao | H01R 31/06 439/11 |
| 7,517,253 | B1 * | 4/2009 | Chiang | H01R 12/58 439/218 |
| 7,815,450 | B1 * | 10/2010 | Chen | H01R 27/00 439/172 |
| 7,828,569 | B2 * | 11/2010 | Aronson | H01R 24/64 439/218 |
| 7,938,659 | B1 * | 5/2011 | Zhu | H01R 13/502 439/218 |
| 8,100,724 | B2 * | 1/2012 | Lin | H01R 12/716 439/218 |
| 8,133,078 | B2 * | 3/2012 | Lin | H01R 12/712 439/218 |
| 8,784,123 | B1 * | 7/2014 | Leiba | H01R 27/00 439/218 |
| 9,923,321 | B2 * | 3/2018 | Wang | H01R 27/00 |

* cited by examiner

*Primary Examiner* — Phuong Dinh
(74) *Attorney, Agent, or Firm* — Li&Cai Intellectual Property (USA) Office

(57) ABSTRACT

A connector assembly and a hybrid connector are provided. The hybrid connector includes a base, a tongue, two extending bases, a first terminal assembly and a second terminal assembly. The tongue is formed by extending ahead of the first front surface of the base. The two extending bases are disposed on two horizontal sides of the base, and each extending base is disposed on either side of the base. The first terminal assembly is disposed on the base and the tongue and arranged in accordance with a general interface specification for universal serial bus (USB) Type-C. The second terminal assembly is disposed on the two extending bases and utilized for transmitting the Ethernet transmission protocol signal.

10 Claims, 8 Drawing Sheets

CONNECTOR ASSEMBLY AND HYBRID CONNECTOR THEREOF

BACKGROUND

1. Technical Field

The present disclosure is related to a connector assembly and a hybrid connector thereof, and in particular to a hybrid connector that is able to connect to two different types of receptacle plugs.

2. Description of Related Art

With the increasing progress of modern technology, electronic devices, such as notebook computers, have been developed towards the light and thin characteristics, resulting in the limitation on designing the size of output/input ports (I/O port), particularly on the height.

In order to improve the space utilization, a design which integrates USB Type-C connectors and RJ45 connectors into one device by a stacking manner has been come up with for the connector. However, some disadvantages such as a larger space occupation and a higher stack height still exist in the conventional design and are unfavorable for thinning electronic devices. Therefore, there is still room for improvement in the design of the conventional connector.

SUMMARY

The object of the present disclosure is to provide a connector assembly and a hybrid connector thereof to improve the problems associated with the current technology.

In order to achieve the aforementioned object, according to one embodiment of the present disclosure, a hybrid connector is provided. The hybrid connector includes a base, a tongue, two extending bases, a first terminal assembly and a second terminal assembly. The tongue is formed by extending ahead of the first front surface of the base. The two extending bases are disposed on two horizontal sides of the base, and each extending base is disposed on either side of the base. The first terminal assembly is disposed on the base and the tongue and arranged in accordance with a general interface specification for universal serial bus (USB) Type-C. The second terminal assembly is disposed on the two extending bases and utilized for transmitting the Ethernet transmission protocol signal.

In order to achieve the aforementioned object, according to another embodiment of the present disclosure, a connector assembly including a hybrid connector as aforementioned and a receptacle plug with a non-standard USB Type-C interface specification is provided. The receptacle plug includes a plug body, a plug base, two extending plug bases, a third terminal assembly and a forth terminal assembly. The plug base is formed by extending ahead of the plug body. The two extending plug bases are formed by extending ahead the plug body and integrally connected to two sides of the plug base. The third terminal assembly is disposed on the plug base and arranged in accordance with a general interface specification for USB Type-C. The forth terminal assembly is disposed on the two extending plug bases and utilized for transmitting the Ethernet transmission protocol signal. Further, when the receptacle plug is connected to the hybrid connector, the third terminal assembly is electrically connected to the first terminal assembly and the forth terminal assembly is electrically connected to the second terminal assembly.

To sum up, the advantages of the present disclosure are that the connector assembly and the hybrid connector thereof according to the present disclosure can achieve the aforementioned object by means of the technical feature of "a plurality of first terminals disposed on the tongue and arranged in accordance with a general interface specification for universal serial bus (USB) Type-C" and "a plurality of second terminals disposed on the two horizontally extending bases and utilized for transmitting Ethernet transmission protocol signals", so as to achieve the functions of data, video, electricity and internet signal transmission simultaneously, and to improve disadvantages of conventional connectors such as a larger space occupation and a higher stack height, thereby meeting the requirement for miniaturization.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
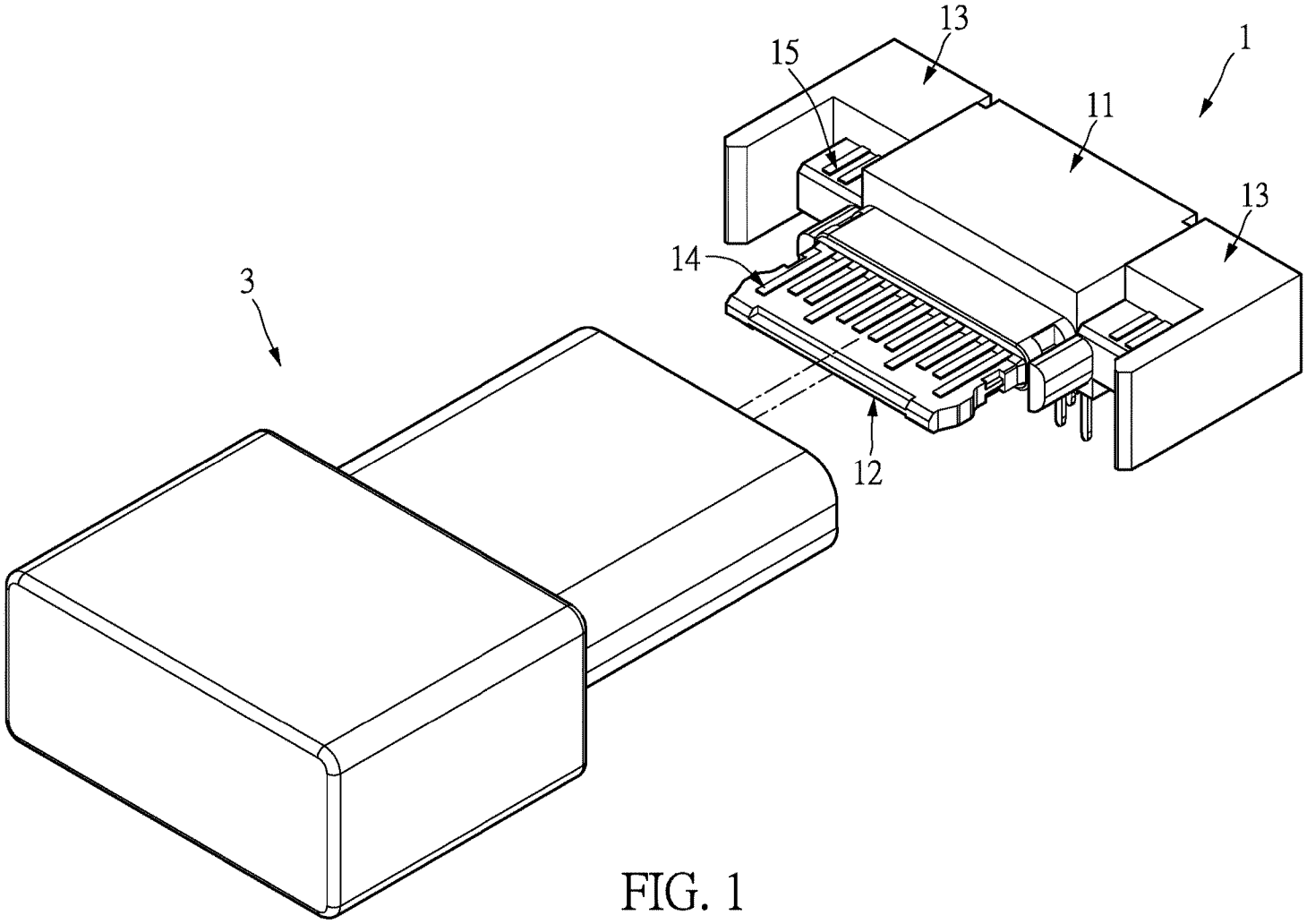
FIG. 1 is a schematic view of a hybrid connector and a standard receptacle plug according to the present disclosure.

Reference will now be made in detail to the exemplary embodiments of the present disclosure, examples of which are illustrated in the accompanying drawings. Wherever possible, the same reference numbers are used in the drawings and the description to refer to the same or like parts. The present disclosure may be implemented or applied by various specific embodiments, and the details in this specification may be varied and modified without departing from the spirit of the present disclosure based on different views and applications. The drawings of the present disclosure are simply illustrative and are not depicted in terms of actual dimensions. The following description will further illustrate the related technical contents of the present disclosure, and should not be construed as restricting the technical scope of the present disclosure.

It is should be noted that the terms "first", "second", "third", etc. may be used herein to describe various elements or signals, however such elements or signals should not be construed as limiting the terms. These terms are used to distinguish one element from another element, or to distinguish a signal from another signal. In addition, as used herein, the term "or" may include, as the case may be, all combinations of any one or more of the listed items.

FIG. 1 to FIG. 8 illustrate the embodiment of the present disclosure. The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

Figure 2:
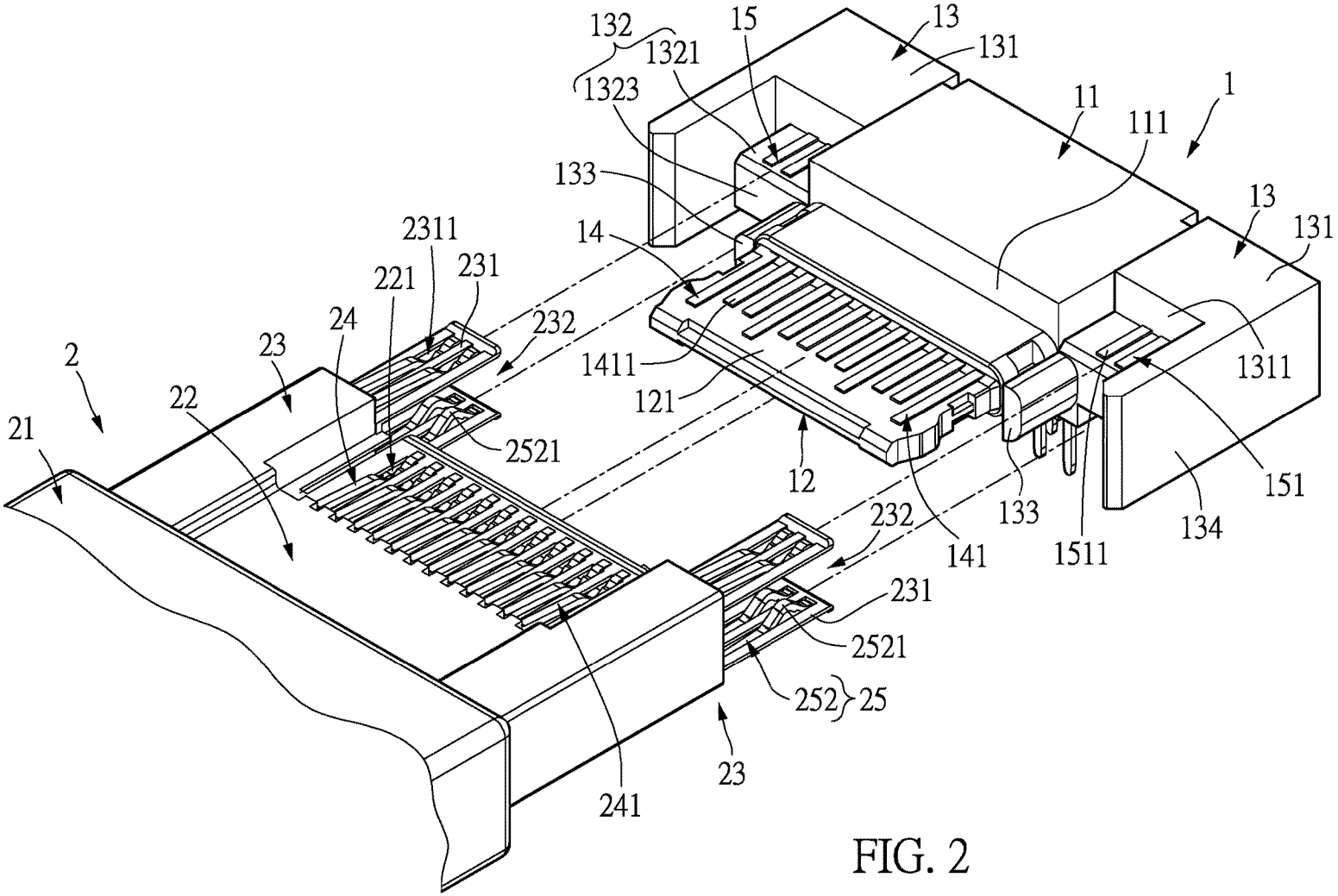
FIG. 2 is a schematic view of the hybrid connector and a receptacle plug according to the present disclosure.

As shown in FIG. 1 and FIG. 2, the connector assembly of the present disclosure includes a hybrid connector 1 and a receptacle plug 2 or a standard receptacle plug 3 that are able to connect with the hybrid connector 1. The standard receptacle plug 3 illustrated in FIG. 1 is a USB Type-C plug with the standard interface specification; the receptacle plug 2 illustrated in FIG. 2 is a USB Type-C plug with non-standard interface specifications. Hence, the hybrid connector 1 can be connected to two different types of receptacle plugs. The hybrid connector 1 can be disposed in hosts, which exemplarily are notebooks or any related electronic devices. The standard receptacle plug 3 is a USB Type-C plug with the standard interface specification, which is the well-known prior art for those skilled therein, and the detailed description is omitted herein for the sake of brevity.

Figure 3:
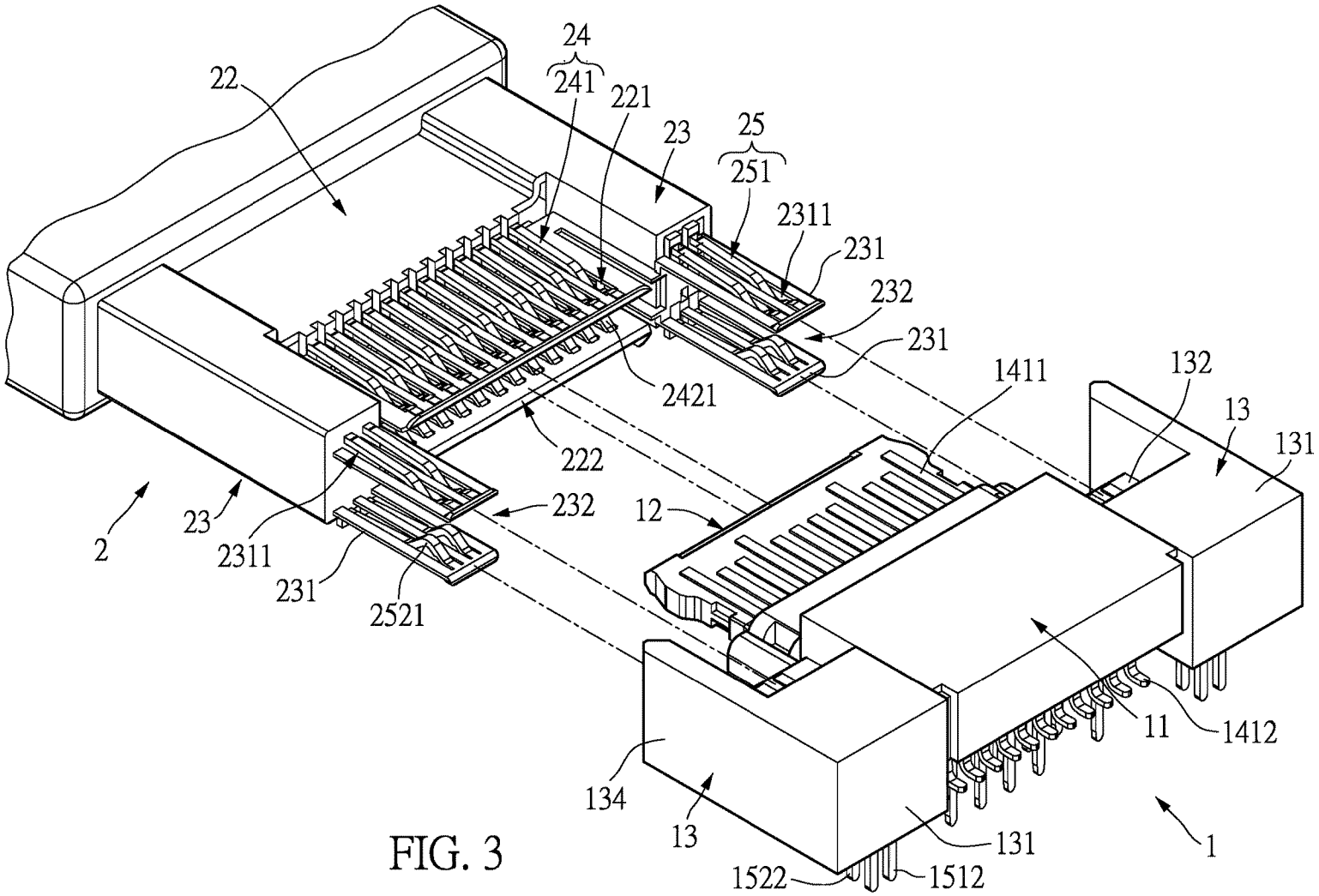
FIG. 3 is another schematic view of the hybrid connector and the receptacle plug according to the present disclosure.

As shown in FIGS. 1 to 3, the hybrid connector 1 includes a base 11, a tongue 12, two extending bases 13, a first terminal assembly 14 and a second terminal assembly 15. The following description will further illustrate all the elements of the hybrid connector 1 and the connection relationship among them.

The tongue 12 is formed by extending ahead of the first front surface 111 of the base 11. More specifically, the tongue 12 is a flat plate, and the size of the tongue 12 fits into the general interface specification for USB Type-C.

The two extending bases 13 are disposed on two horizontal sides of the base 11, and each of the two extending bases 13 is disposed on either side of the base 11. The two extending bases 13 can individually integrally connect to either side of the base 11. In other words, the two extending bases 13 and the base 11 can be formed as a one-piece component or not. Furthermore, the thickness of each extending base 13 is not greater than that of the base 11.

Figure 4:
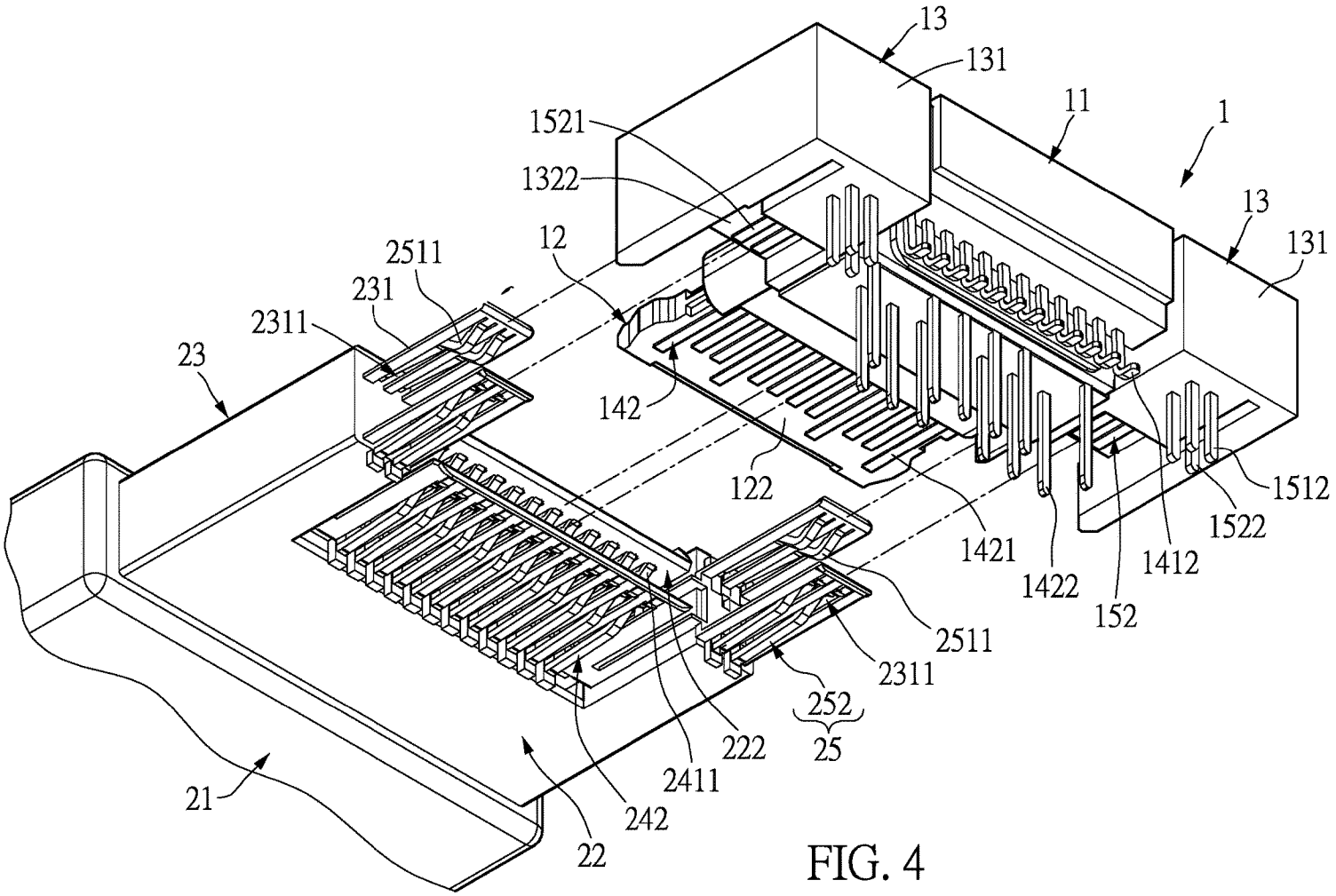
FIG. 4 is still another schematic view of the hybrid connector and the receptacle plug according to the present disclosure.

The first terminal assembly 14 is disposed on the base 11 and the tongue 12, and the arrangement thereof is in accordance with the general interface specification for universal serial bus (USB) Type-C. More specifically, the first terminal assembly 14 includes a plurality of first upper terminals 141 and a plurality of first lower terminals 142. According to the present embodiment, the first terminal assembly 14 includes twelve first upper terminals 141 and twelve first lower terminals 142. Each first upper terminal 141 has a first upper connecting pin 1411, and each first upper connecting pin 1411 is disposed on a first upper surface 121 of the tongue 12 and spaced from each other (as shown in FIG. 1). Each first lower terminal 142 has a first lower connecting pin 1421, and each first lower connecting pin 1421 is disposed on a first lower surface 122 of the tongue 12 and spaced from each other (as shown in FIG. 4). More specifically, each first upper terminal 141 further has a first upper connecting pin 1412. These first upper connecting pins 1412 are respectively integrally connected to the first upper connecting pins 1411 and penetrate the base 11 (as shown in FIG. 4). In addition, each first lower terminal 142 further has a first lower soldering pin 1422. The first lower soldering pins 1422 are respectively integrally connected to the first lower connecting pins 1421 and penetrate the base 11 (as shown in FIG. 4).

The plurality of first upper terminals 141 can include at least one upper signal terminal, at least one upper power supply terminal and at least one upper ground terminal. The plurality of first lower terminals 142 can include at least one lower signal terminal, at least one lower power supply terminal and at least one lower ground terminal. Moreover, the arrangement of the plurality of first upper terminals 141 as above is opposite to that of the plurality of first lower terminals 142, such that the signal transmission can be achieved in either connecting direction when being connected to the receptacle plugs with standard USB Type-C interface specification.

The second terminal assembly 15 is disposed on the two extending bases 13. The second terminal assembly 15 fits into RJ45 transmission protocol specifications, which means that the second terminal assembly 15 is disposed on the two extending bases 13 and utilized for transmitting the Ethernet transmission protocol signal. In addition, the second terminal assembly 15 includes at least one transmission positive terminal ($Tx^+$), at least one transmission negative terminal ($Tx^-$), at least one receive positive terminal ($Rx^+$) and at least one receive negative terminal ($Rx^-$).

Figure 5:
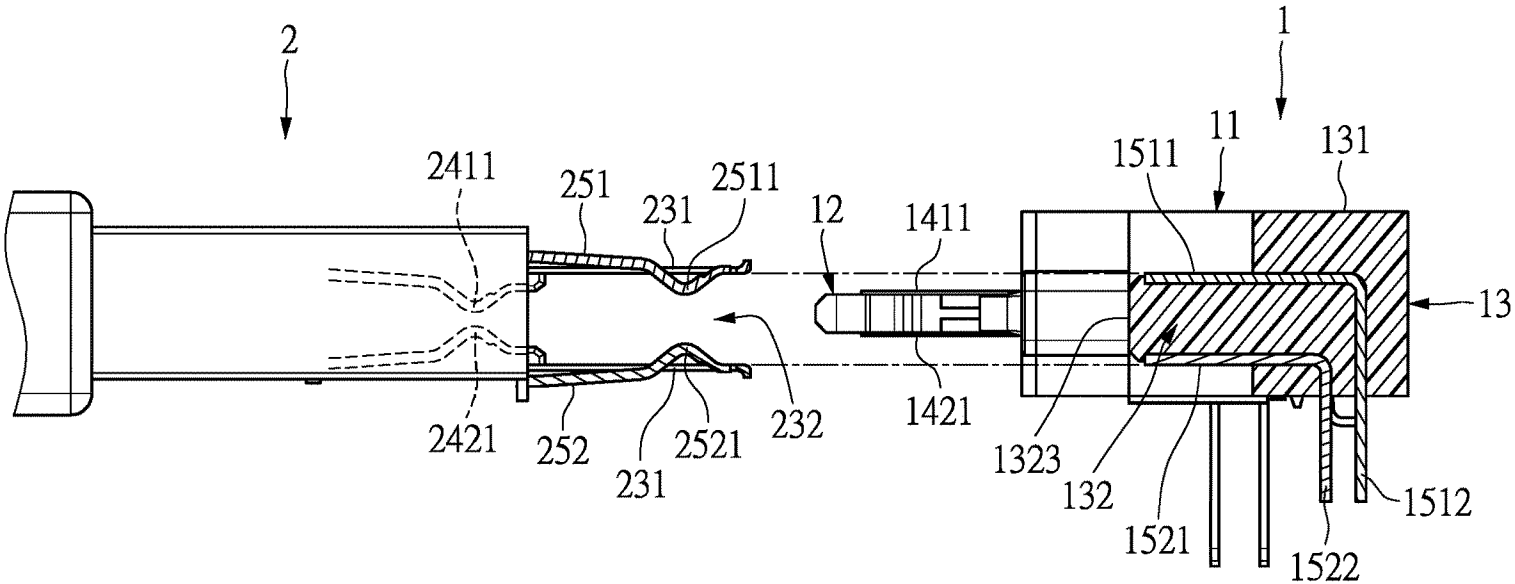
FIG. 5 is a side view of the hybrid connector and the receptacle plug of FIG. 2, according to the present disclosure.

More specifically, each extending base 13 has a horizontal portion 131 and a connecting receiver 132 formed by protruding ahead of a second front surface 1311 of the horizontal portion 131. The second terminal assembly 15 includes a plurality of second upper terminals 151 and a plurality of second lower terminals 152. In the present embodiment, the second terminal assembly 15 includes four second upper terminals 151 and four second lower terminals 152. Each second upper terminal 151 has a second upper connecting pin 1511, and the second upper connecting pins 1511 are disposed on a second upper surface 1321 of the connecting receiver 132 (as shown in FIG. 2); each second lower terminals 152 has a second lower connecting pin 1521, and the second lower connecting pins 1521 are disposed on a second lower surface 1322 of the connecting receiver 132 (as shown in FIG. 4). More specifically, each second upper terminal 151 has a second upper soldering pin 1512, and each second upper soldering pin 1512 is integrally connected to each second upper connecting pin 1511 and penetrates the horizontal portion 131 (as shown in FIG. 5). Similarly, each second lower terminal 152 has a second lower soldering pin 1522, and each second lower soldering pin 1522 is integrally connected to each the second lower connecting pin 1521 and penetrates the horizontal portion 131 (as shown in FIG. 5).

The thickness of the horizontal portion 131 is not greater than that of the base 11, and the thickness of the connecting receiver 132 protruding from the horizontal portion 131 is smaller than that of the horizontal portion 131 and smaller than that of the base 11 as well.

A first front surface 1323 of the connecting receiver 132 can be considered as a blocking surface, which is substantially flush with the first front surface 111 of the base 11, such that the third front surface 1323 of the connecting receiver 132 can block the receptacle plug with standard USB Type-C interface specification. Therefore, when the standard USB Type-C receptacle plug is connected to the hybrid connector 1, it would be blocked by the third front surface 1323 of the connecting receiver 132, and cannot to be electrically connected to the second upper connecting pins 1511 and the second lower connecting pins 1521 exposed on the connecting receiver 132.

Each extending base 13 further has a guiding column 133 formed by extending ahead of the third front surface 1323 of the connecting receiver 132, such that the two guiding columns 133 are respectively disposed at both sides of the tongue 12. Hence, the standard receptacle plug with USB Type-C interface specification can be guided by the two guiding columns 133 without causing an oblique insertion when being plugged into the hybrid connector.

In addition, each extending base 13 further includes a vertical portion 134 extending ahead of the outside of the extending part 131, such that the vertical portion 134 and the horizontal portion 131 cooperatively form an L-shaped structure.

The following description will further illustrate details of the receptacle plug 2. As shown in FIG. 2 to FIG. 6, the receptacle plug 2 includes a plug body 21, a plug base 22, two extending plug bases 23, a third terminal assembly 24 and a forth terminal assembly 25. The following description will further illustrate all the elements of the receptacle plug 2 and the connection relationship among them.

Figure 6:
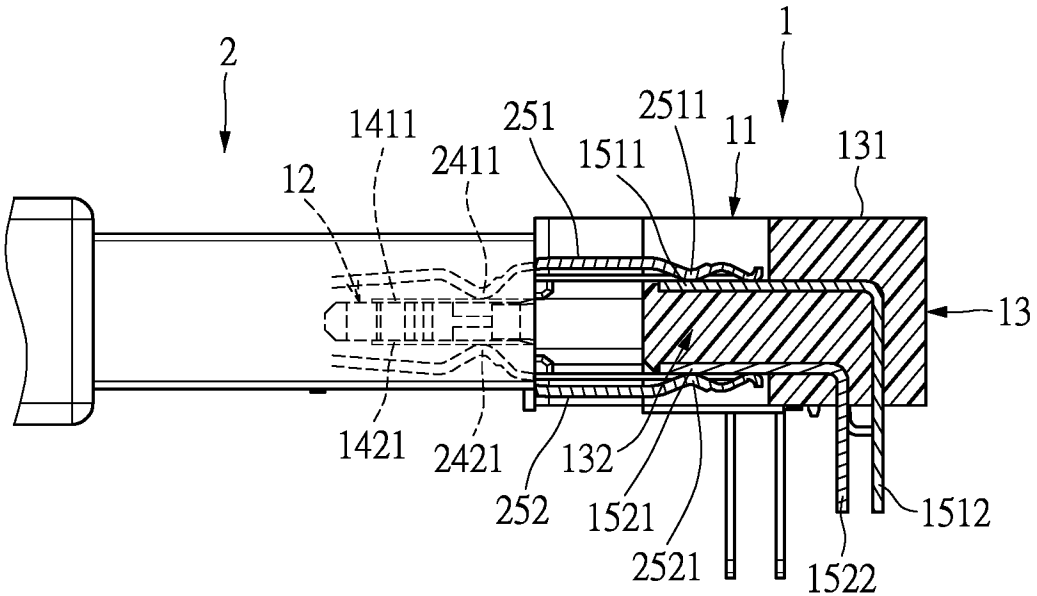
FIG. 6 is a diagram showing the hybrid connector and the receptacle plug connected to each other, according to the present disclosure.

The plug base 22 is formed by extending ahead of the plug body 21, and the third terminal assembly 24 is disposed on the plug base 22. The arrangement of the third terminal assembly 24 fits into the general interface specification for universal serial bus (USB) Type-C. More specifically, a plurality of first grooves 221 and a first connecting cavity 222 of the plurality of first grooves 221 are disposed on the plug base 22, and the third terminal assembly 24 is accommodated in the plurality of first grooves 221. The third terminal assembly 24 includes a plurality of third upper terminals 241 and a plurality of third lower terminals 242. In the present disclosure, the third terminal assembly 24 includes twelve third upper terminals 241 and twelve third lower terminals 242. Each third upper terminal 241 has a third upper connecting pin 2411, and each third upper connecting pin 2411 curves and extends downward into the first connecting cavity 222; each third lower terminal 242 has a third lower connecting pin 2421, and each third lower connecting pin 2421 curves and extends upward into the first connecting cavity 222. The tongue 12 can insert into the first connecting cavity 222, such that the third upper connecting pins 2411 of the third terminal assembly 24 are electrically connected to the first upper connecting pins 1411 of the first terminal assembly 14, and the third lower connecting pins 2421 of the third terminal assembly 24 are electrically connected to the first lower connecting pins 1421 of the first terminal assembly 14 (as shown in FIG. 5 and FIG. 6), to transmit data, video and electricity.

The two extending plug bases 23 are respectively integrally connected to either side of the plug base 22, and the forth terminal assembly 25 is disposed on the two extending plug bases 23. More specifically, each extending plug base 23 has two extending plates 231 extending ahead of each extending plug base 23 in parallel and a second connecting cavity 232 disposed therebetween. Each of the two extending plates 231 includes a plurality of second grooves 2311 in which the forth terminal assembly 25 is accommodated. The forth terminal assembly 25 includes a plurality of forth upper terminals 251 and a plurality of forth lower terminals 252. According to the present embodiment, the forth terminal assembly 25 includes four forth upper terminals 251 and four forth lower terminals 252. Each forth upper terminal 251 has a forth upper connecting pin 2511, and each forth upper connecting pin 2511 curves and extends downward into the second connecting cavity 232; each forth lower terminals 252 has a forth lower connecting pin 2521, and each forth lower connecting pin 2521 curves and extends upward into the second connecting cavity 232. The two connecting receivers 132 can respectively insert into the two second connecting cavities 232, such that the forth upper connecting pins 2511 of the forth terminal assembly 25 are electrically connected to the second upper connecting pins 1511 of the second terminal assembly 15, and the forth lower connecting pins 2521 of the forth terminal assembly 25 are electrically connected to the second lower connecting pins 1521 of the second terminal assembly 15 (as shown in FIG. 5 and FIG. 6), to achieve the data, video and electricity transmission. In addition, the third upper connecting pins 2411 and the third lower connecting pins 2421 are behind the forth upper connecting pins 2511 and the forth lower connecting pins 2521 along the connecting direction.

Figure 7:
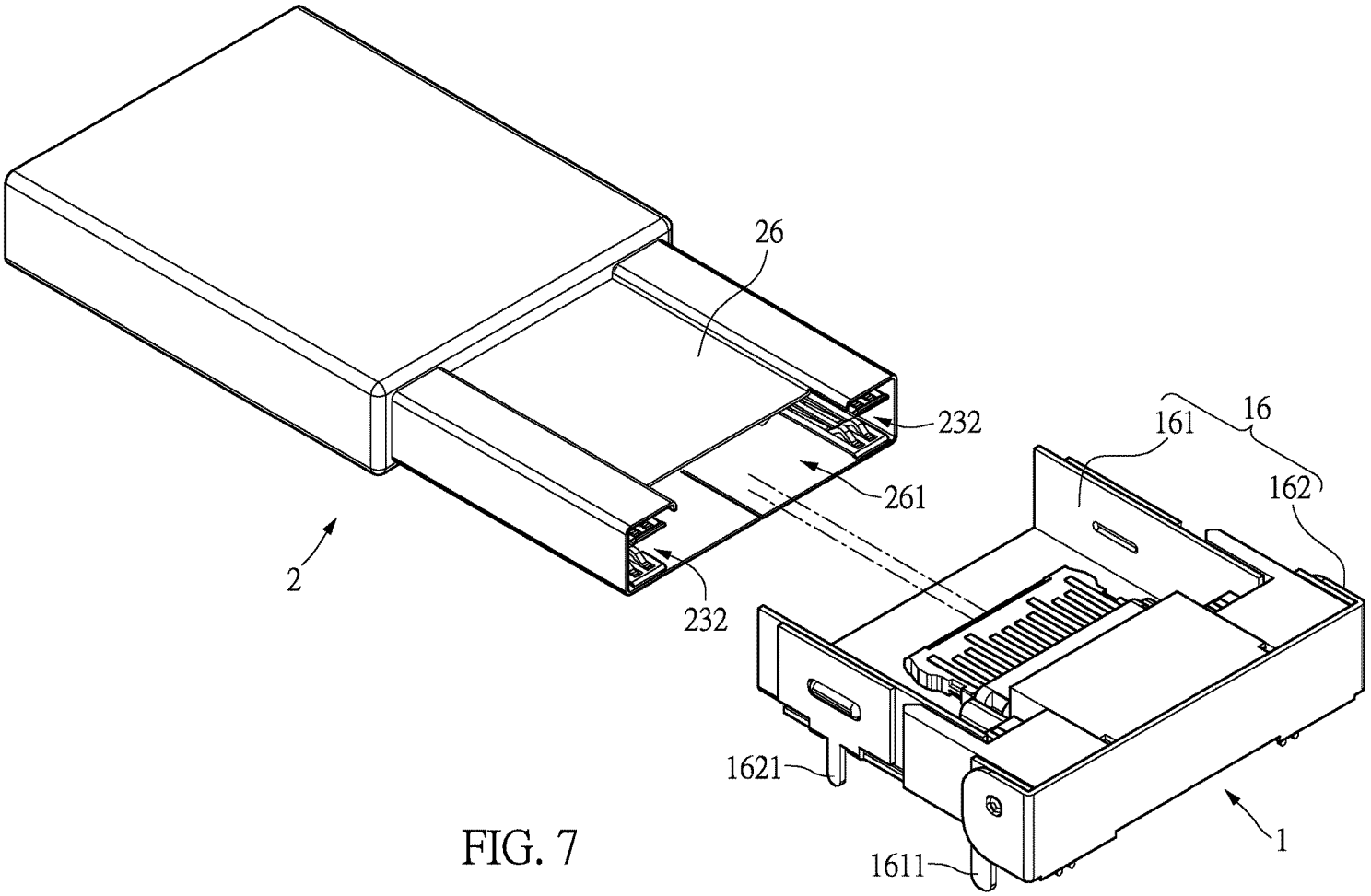
FIG. 7 is a schematic view of the hybrid connector with a shielding casing and the receptacle plug with a metal casing.
Figure 8:
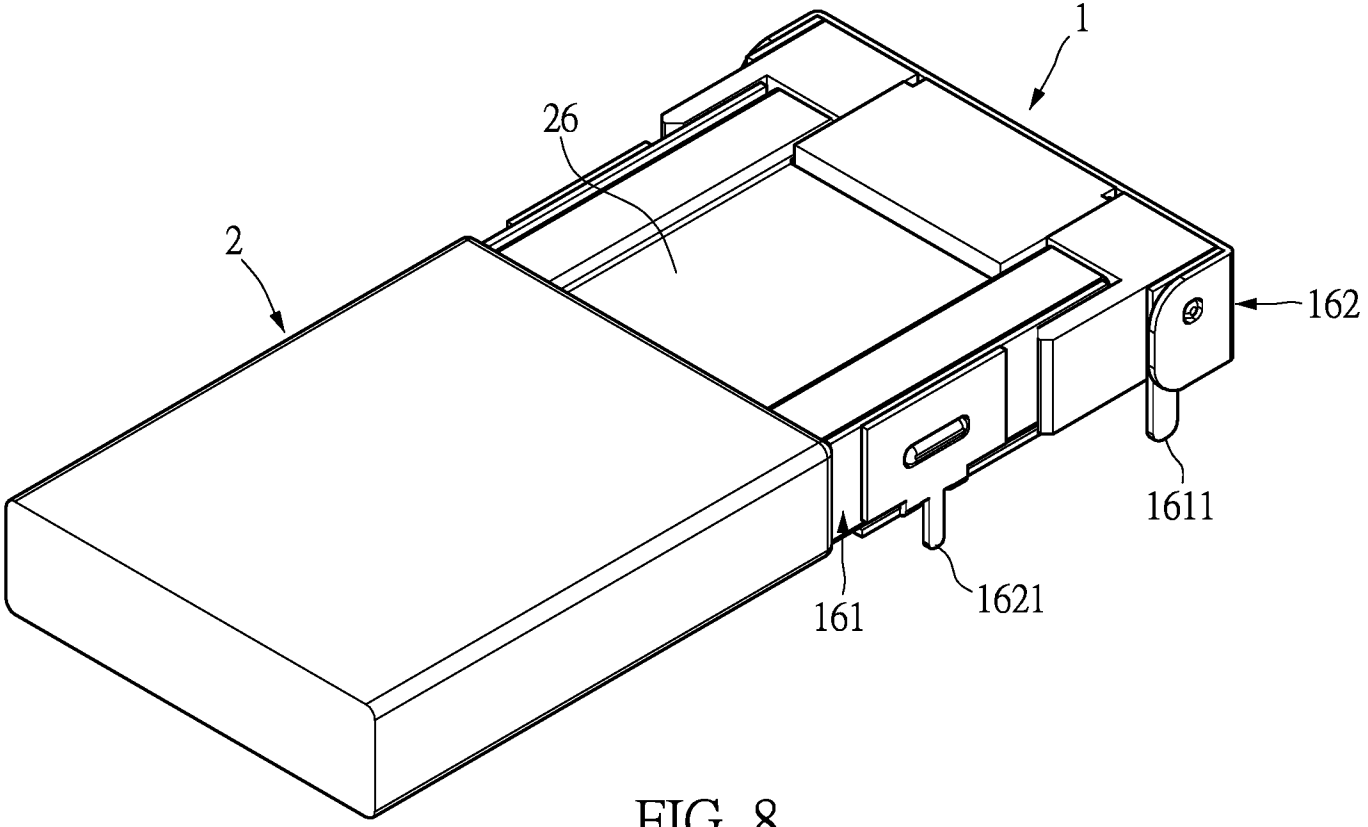
FIG. 8 is a schematic view showing the hybrid connector and the receptacle plug from FIG. 7, according to the present disclosure.

Referring to FIG. 7 and FIG. 8, the receptacle plug 2 further includes a metal casing 26 surrounding the plug base 22 and the two extending plug bases 23, the metal casing 26 has a connecting opening 261 connected to the first connecting cavity 222 and the two second connecting cavities 232. Therefore, the tongue 12 and the two connecting receivers 132 can insert into the first connecting cavity 222 and the two second connecting cavities 232, respectively.

Furthermore, the hybrid connector 1 also includes a shielding casing 16 that covers the base 11, the tongue 12 and the two extending bases 13. The shielding casing 16 can be a one-piece form or a multi-piece form. The shielding casing 16 illustrated in FIGS. 7 and 8 is a multi-piece form, which includes an inner casing 161 and an outer casing 162 combining with the outside of the inner casing 161. The inner casing 161 and the outer casing 162 have first positioning pins 1611 and second positioning pins 1621, respectively, such that the hybrid connector 1 can be plugged into the host (such as the master mask of electronic devices). The metal casing 26 matches the shielding casing 16, so to accommodate the shielding casing 16 therein.

In summary, the advantages of the present disclosure are that the connector assembly and the hybrid connector thereof according to the present disclosure can achieve the aforementioned object by means of the technical feature of "a plurality of first terminals disposed on the tongue and arranged in accordance with a general interface specification for universal serial bus (USB) Type-C" and "a plurality of second terminals disposed on the two horizontally extending bases and utilized for transmitting Ethernet transmission protocol signals", so as to perform the functions of data, video, electricity and internet signal transmission simultaneously, and to improve disadvantages such as a larger space occupation and a higher stack height, thereby meeting the requirement for miniaturization.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present invention delineated by the following claims.

What is claimed is:

1. A hybrid connector, comprising:

a base;

a tongue formed by extending ahead of a first front surface of the base;

two extending bases disposed on two horizontal sides of the base, each extending base being disposed on either side of the base;

a first terminal assembly disposed on the base and the tongue and arranged in accordance with a general interface specification for universal serial bus (USB) Type-C; and a second terminal assembly disposed on the two extending bases and utilized for transmitting the Ethernet transmission protocol signal.

2. The hybrid connector according to claim 1, wherein the thickness of the each extending base is not greater than the thickness of the base.

3. The hybrid connector according to claim 1, wherein the first terminal assembly includes a plurality of first upper terminals and a plurality of first lower terminals, each of the first upper terminals having a first upper connecting pin, wherein each first upper connecting pin is disposed on a first upper surface of the tongue and spaced from each other, each of the first lower terminals having a first lower connecting pin, wherein each first lower connecting pin is disposed on the first lower surface of the tongue and spaced from each other, each of the first upper terminals having a first upper soldering pin, wherein each of the first upper soldering pins is integrally connected to each of the first upper connecting pins and penetrates the base, and each of the first lower terminals having a first lower soldering pin, wherein each of the first lower soldering pins is integrally connected to each of the first lower connecting pins and penetrates the base.

4. The hybrid connector according to claim 3, wherein each of the two extending bases has a horizontal portion and a connecting receiver formed by protruding ahead of a second front surface of the horizontal portion.

5. The hybrid connector according to claim 4, wherein the second terminal assembly includes a plurality of second upper connecting pins and a plurality of second lower connecting pins, each of the second upper terminals having a second upper connecting pin, wherein the second upper connecting pins are disposed on a second upper surface of the connecting receiver, each of the second lower terminals having a second lower connecting pin, wherein the second lower connecting pins are disposed on a second lower surface of the connecting receiver, each of the second upper terminals having a second upper soldering pin, wherein each of the second upper soldering pins is integrally connected to each of the second upper connecting pins and penetrates correspondingly to the horizontal portion, and each of the second lower terminals having a second lower soldering pin, wherein each of the second lower soldering pins is integrally connected to each of the second lower connecting pins and penetrates correspondingly to the horizontal portion.

6. The hybrid connector according to claim 4, wherein each second front surface of each connecting receiver is a blocking surface that is substantially flush with the first front surface of the base.

7. A connector assembly including a hybrid connector according to claim 1 and a receptacle plug with a non-standard USB Type-C interface specification, wherein the receptacle plug comprises:

a plug body;

a plug base formed by extending ahead of the plug body;

two extending plug bases formed by extending ahead the plug body and integrally connected to two sides of the plug base;

a third terminal assembly disposed on the plug base and arranged in accordance with a general interface specification for USB Type-C; and a forth terminal assembly disposed on the two extending plug bases and utilized for transmitting the Ethernet transmission protocol signal;

wherein when the receptacle plug is connected to the hybrid connector, the third terminal assembly is electrically connected to the first terminal assembly and the forth terminal assembly is electrically connected to the second terminal assembly.

8. The connector assembly according to claim 7, wherein the plug base has a plurality of first grooves and a first connecting cavity connected to the plurality of first grooves, the third terminal assembly is accommodated in the plurality of first grooves and includes a plurality of third upper terminals and a plurality of third lower terminals; each of the third upper terminals has a third upper connecting pin, wherein the third upper connecting pins curve and extend downward into the first connecting cavity; each third lower terminal has a third lower connecting pin, wherein the third lower connecting pins curve and extend upward into the first connecting cavity; the first connecting cavity is for the tongue to insert therein.

9. The connector assembly according to claim 8, wherein each of the two extending plug bases has two extending plates extending ahead of each extending plug base in parallel and a second connecting cavity disposed therebetween, wherein each of the two extending plates has a plurality of second grooves in which the forth terminal assembly is accommodated, the forth terminal assembly includes a plurality of forth upper terminals and a plurality of forth lower terminals, each forth upper terminals has a forth upper connecting pin, the forth upper connecting pins curve and extend downward into the second connecting cavity; each forth lower terminals has a forth lower connecting pin, the forth lower connecting pins curve and extend upward into the second connecting cavity; the second connecting cavities is for the connecting receivers to insert therein.

10. The connector assembly according to claim 9, wherein a metal casing surrounds the plug base and the two extending plug bases, the metal casing has a connecting opening, and the connecting opening is connected to the first connecting cavity and the second connecting cavities.

* * * * *